US005392701A

United States Patent [19]

Schiel

[11] Patent Number: 5,392,701

[45] Date of Patent: Feb. 28, 1995

[54] CALENDER FOR TREATING A MATERIAL WEB PARTICULARLY A PAPER WEB

[75] Inventor: Christian Schiel, Heidenheim, Germany

[73] Assignee: J.M. Voith & GmbH, Heidenheim, Germany

[21] Appl. No.: 193,513

[22] Filed: Feb. 8, 1994

Related U.S. Application Data

[63] Continuation of Ser. No. 74,020, Jun. 9, 1993, abandoned, which is a continuation of Ser. No. 886,703, May 21, 1992, abandoned.

[30] Foreign Application Priority Data

May 29, 1991 [DE] Germany ..... 4117596

[51] Int. Cl.[6] ..... B30B 15/34; D21G 1/02

[52] U.S. Cl. ..... 100/93 RP; 34/68; 34/640; 100/161; 118/101; 162/206; 219/469; 427/366; 432/60

[58] Field of Search ..... 100/38, 93 RP, 161, 100/174; 34/1 B, 1 C, 18, 68, 156; 72/200, 202; 118/60, 101; 162/206; 219/244, 469–471; 427/366; 432/60, 228

[56] References Cited

U.S. PATENT DOCUMENTS

| | | | |
|---|---|---|---|
| 3,632,984 | 1/1972 | Brownscombe | 219/469 |
| 3,952,696 | 4/1976 | Saupe | 118/101 X |
| 4,064,933 | 12/1977 | Schuman | 219/469 X |
| 4,112,280 | 9/1978 | Salsich et al. | 219/469 X |
| 4,114,021 | 9/1978 | Nishide et al. | 219/469 X |
| 4,518,845 | 5/1985 | Svendsen | 219/469 X |
| 4,605,366 | 8/1986 | Lehmann et al. | 100/93 RP X |
| 4,610,617 | 9/1986 | Christ et al. | 100/93 RP X |
| 4,653,395 | 3/1987 | Verkasalo | 100/93 RP X |

FOREIGN PATENT DOCUMENTS

| | | | |
|---|---|---|---|
| 2160553 | 6/1973 | Germany | 219/469 |
| 3013648 | 10/1981 | Germany | 100/93 RP |
| 3545123 | 7/1988 | Germany . | |
| 3720132 | 12/1988 | Germany . | |

OTHER PUBLICATIONS

R. H. Crotogino, "Das Glätten von ungestrichenen holzhaltigen Papieren", Das Papier 38, Jahrgang, Heft 10A, 1984, pp. V203–V210.

*Primary Examiner*—Stephen F. Gerrity
*Attorney, Agent, or Firm*—Baker & Daniels

[57] ABSTRACT

A calender for treating a material web, particularly a paper web, with at least two rolls forming with each other a roll gap for passage of the web, with a heating system and with a removable cover system. The cover system comprises a foil which is tightened at least around part of the circumference of at least one of the rolls while forming a machine-wide gap between itself and the shell surface of the respective roll, and extending in planes situated parallel to the roll axes.

9 Claims, 5 Drawing Sheets

PRIOR ART

CALENDER FOR TREATING A MATERIAL WEB PARTICULARLY A PAPER WEB

This is a continuation of application Ser. No. 08/074,020, filed Jun. 9, 1993 (now abandoned), which was a continuation of application Ser. No. 07/886,703, filed May 21, 1992, (now abandoned).

BACKGROUND OF THE INVENTION

The invention concerns a calender for treating a material web, particularly a paper web, of the type including a roll gap formed by at least two rolls for passage of the web, and including a heating system and a removable cover system.

Reference is made to the following art, which art is described in greater detail hereinafter:

(1) DE 35 45 123 A1

(2) DE 37 20 132 A1

(3) "Das Papier" 1984, p. V 203 ff.

The invention relates primarily to calenders for the paper industry, where calenders serve to glaze the paper. The paper passes the individual roll gaps and undergoes heavy pressing. Contact forces between two adjacent rolls are particularly important for glazing of the paper. The moisture of the paper and its temperature are also of importance. Papers of greater moisture are easier to glaze than dry papers; the glaze increases thus with increasing moisture. The effect is approximately proportional. The same is true for the contact force, which also is called line force. The higher the line force, the greater is also the glaze.

The paper temperature is a very important parameter for the glaze. Here too, the same applies as for the two other parameters: the glaze increases in proportion to the paper temperature.

It should be noted, though, that the temperature of the paper web itself is particularly important, but not the temperature of the roll. When heating the paper web by first heating the rolls, the heat from the rolls must be transferred to the paper web before it becomes usable for glazing. A problem arises here because the rolls transfer their heat not only to the paper web but also to the surroundings, which is highly undesirable. The result is that the required heat capacity—at the same paper moisture and same line force—increases overproportionally. These correlations have been described in reference (3) above.

Known from reference (1) is a calender where hoods are provided which partly surround the rolls during the operation. This is to avoid heat losses of the stated kind. While such hoods are removable, for instance by moving or swinging them out of the way, they are nonetheless very impractical because they impede the accessibility of the calender in the event of operational failure. If for any reason they are briefly opened slightly during the operation, for example due to the vibrations associated with the operation, this leads to grave changes within the paper web and, thus, to a disuniform glaze.

Reference (2) illustrates and describes various types of roll heating. For example calender rolls may be provided with internal heating, for example by thermal oil. But calender rolls may also be provided with external heating, for instance induction heating. In this case, electromagnetic energy is transferred to the material of the roll body, thereby increasing the temperature of the roll surface.

The problem underlying the invention is to so design a calender for treating a material web wherein the cover can be quickly installed and removed again, that no fluctuations in glaze occur during the operation, and that the manufacturing costs will be kept low.

SUMMARY OF THE INVENTION

This problem is solved through the features of the present invention. A calender for treating a material web, particularly a paper web, is provided. The calender includes at least two rolls which form with each other a roll gap for passage of the web, a heating system and a removable cover system. The cover system comprises a foil which is tightened at least around part of the circumference of at least one of the rolls, while forming a machine-wide gap between itself and the shell surface of the respective roll.

Furthermore, thermal deformations are precluded by selecting suitable foil materials. In this context it is quite possible to supply heat to the paper web from outside. This is accomplished, e.g., using heat radiators which heat the foil. The foil transfers this heat then to the paper web. Alternatively, also induction coils may be arranged outside the foil, which coils generate eddy currents in the roll body, thereby heating it. Also, electrical resistors may be fitted in the foil, for instance in the form of a metal weave, which resistors, in turn, heat the foil.

It goes without saying that the foil may be fashioned differently for meeting various purposes and that various materials may be selected. To enable a high heat supply from outside, heat-resistant material will be used as foil material. Moreover, it is possible to use foil from coated inorganic material, where the inorganic part consists of thin wires, threads or filaments forming a crossed lay or which are woven and knit. The spaces between the fibers may be filled up by a putty compound to an extent such that any remaining residual porosity allows the formation of an air film or air cushion between the foil and roll. Lastly, a material with low or even negative heat expansion may be provided as inorganic material, for instance carbon fibers, quartz glass fibers or special iron-nickel compounds. This prevents the foil from distorting or wrinkling in case of uneven temperature distribution, which may occur, e.g., whenever the external heat supply across the roll length (web width) is unevenly large.

To safeguard at the same time a high heat passage through the air gap between foil and roll and to maintain a maximally evenly high air gap across the width and length of the surface, the foil side facing the roll is provided with a rough surface. These roughnesses may consist, for example, of the crimpings of the weave or of intersecting grooves, etc.

According to one embodiment, guide rolls or fixed sliding surfaces may be provided around which the foil is wrapped. Although this embodiment thus is basically possible, it is believed to be less practical than the preferred embodiment.

The preferred embodiment provides for generating and maintaining between the roll shell and the foil a gas cushion, preferably an air cushion, for maintaining a spacing between the roll shell and the foil. The foil is thus "self-supporting," looping for instance around one of the rolls of a calender, for instance the uppermost roll, on a substantial part of its circumference. The foil design may be such that it can be wound into a box similar to the roll shutter of a window. This box may be located on the one side of the roll gap which the said roll forms with an adjacent roll. Naturally, the box extends across the entire roll length and has a slot for the foil to exit. The other foil end is then contained on the side of said roll gap opposite the slot.

BRIEF DESCRIPTION OF THE DRAWINGS

The above mentioned and other features and objects of this invention, and the manner of attaining them, will become more apparent and the invention itself will be better understood by reference to the following description of embodiments of the invention taken in conjunction with the accompanying drawings, wherein.

Corresponding reference characters indicate corresponding parts throughout the several views. The exemplifications set out herein illustrate preferred embodiments of the invention, and such exemplifications are not to be construed as limiting the scope of the invention in any manner.

DESCRIPTION OF THE PREFERRED EMBODIMENT

Figure 1:
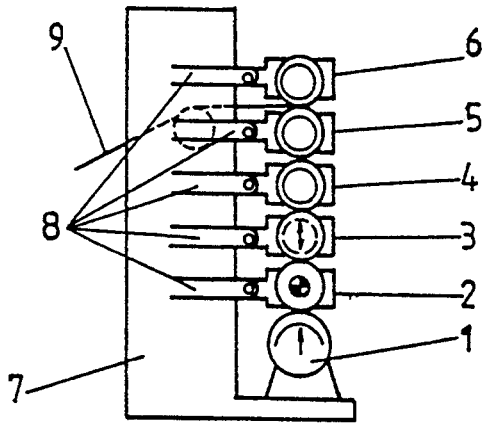
FIG. 1 is a prior calender of modern design, also called a "glazing mill," for wood-containing printing papers.

The glazing mill illustrated in FIG. 1 features overall six rolls 1–6. These are arranged one above the other in a vertical plane. Moreover, the calender comprises an upright 7. The base roll is mounted on a foot of the upright 7. The rolls 2 through 6 are connected with the upright by way of joints 8. The roll 2 is a driven roll. The roll 3 is a flexing compensation roll. The roll 5 is an internally heatable roll. The roll 1 can be raised for purposes of establishing contact pressure. A paper web 9 enters the glazing mill via the lower roll gap between rolls 1 and 2, leaving the glazing mill out of the upper roll gap between rolls 5 and 6.

Figure 2:
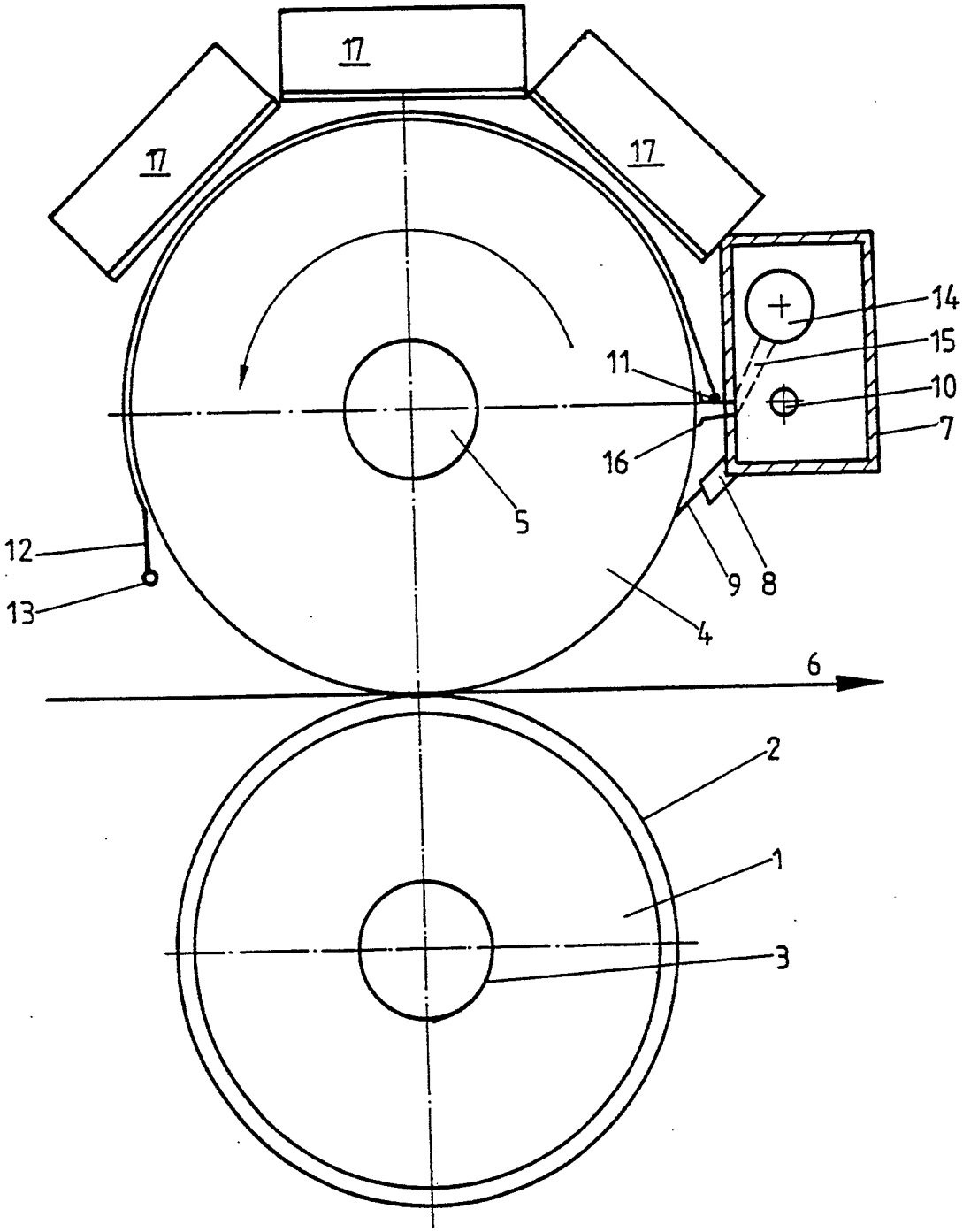
FIG. 2 in schematic illustration, is a two-roll calender according to the invention.

The calender according to FIG. 2 is comprised of a base roll 1 with elastic coating 2 and support journals 3. Additionally a top roll 4 with support journal 5 are provided.

The journals 3 and 5 are on both roll ends mounted in frames (not illustrated). The roll bodies 1 and 4 can be forced on one another by not illustrated means. A paper web 6 runs through between the rolls 1 and 4, from left to right. A traverse 7 with a scraper holder 8 and a blade 9 which can be applied on the roll body 4 is mounted as well, by way of pins 10, on the not illustrated frames.

The scraper body (traverse) 7 comprises a holder 11 for an electrically conductive foil 12 which extends across the length of the roll 4 and part of its circumference, while connected on its other end with a slat 13 as a counterweight.

An electrical voltage can be applied between the holder 11 and the slat 13, thereby causing the conductive foil 12 to heat up. Air is blown between the roll 4 and foil 12 through a line 14 and channels 15. A strip seal 16 prevents the air from escaping opposite to the running direction. The heat transfers from the foil to the air drying layer and thus to the paper web.

Additionally, the roll 4 is heated. This takes place through induction coils 17 heating the magnetic shell of the roll 4 and, thus, also the paper web 6. Instead of induction coils, also heat radiators are usable. Elements 17 (induction coils or radiators), may be subdivided in sections in the direction of the longitudinal axis of the roll, the sections being independently controllable in their capacity.

Figure 3:
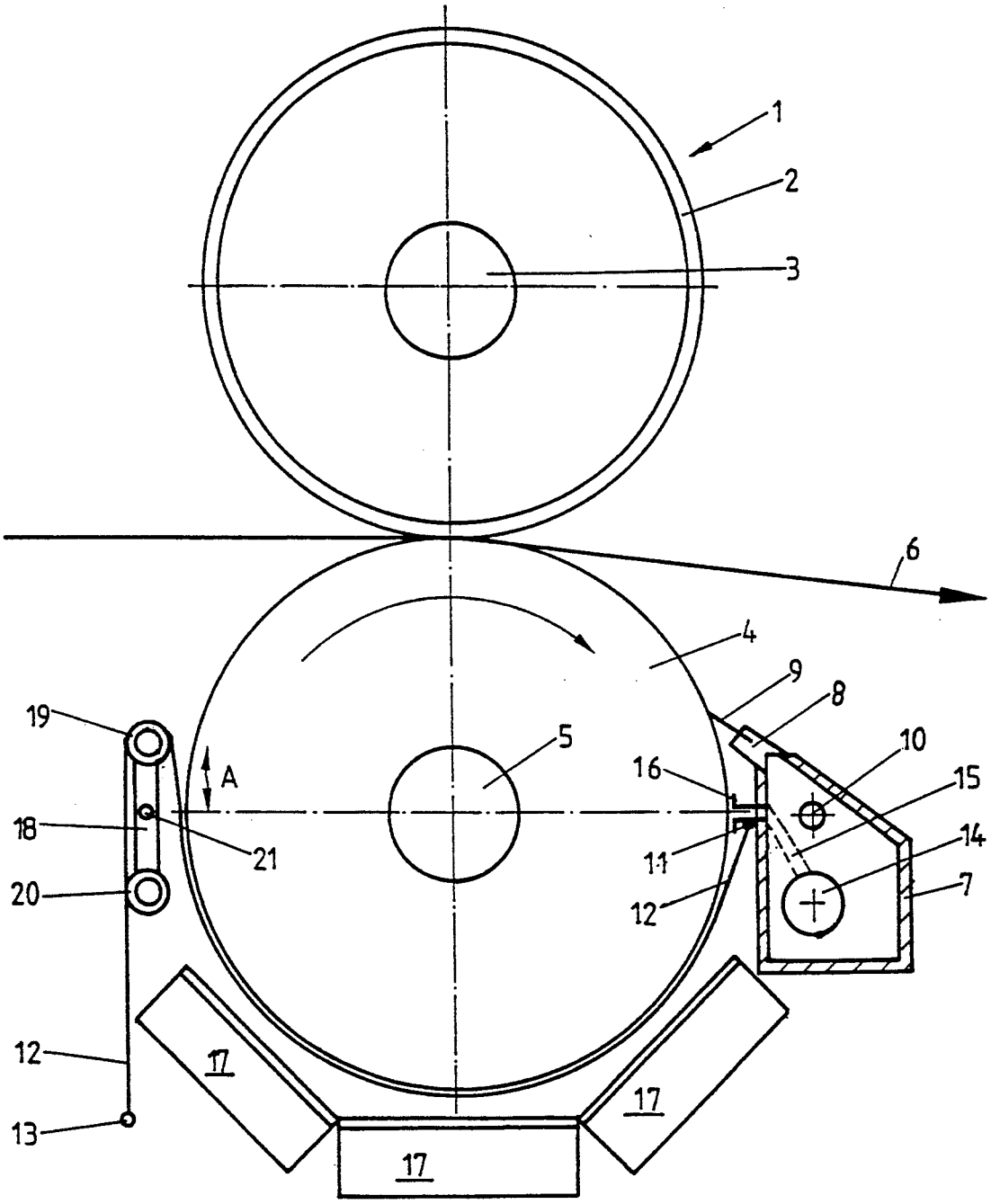
FIG. 3 is another two-roll calender according to the invention.

On the calender according to FIG. 3, identical or corresponding components are referenced as in FIG. 2.

In the case of this calender, a traverse 18 is provided which extends across the entire length of the roll. The traverse 18 has two sleeves 19 and 20. The sleeve 19 is looped by the foil 12, which can slide on the alcove 19. The traverse 18 is adjustable in the direction of double arrow A. The adjustment increases or reduces the wrap angle of the foil 12 around the roll 4. Additionally, the traverse 18 can be swiveled about the pivot 21 so that the conditions at the exit of the foil can be varied, which occasionally may be desirable. Here too, a slat 13 is provided as a counterweight for tensioning the foil 12.

Figure 4:
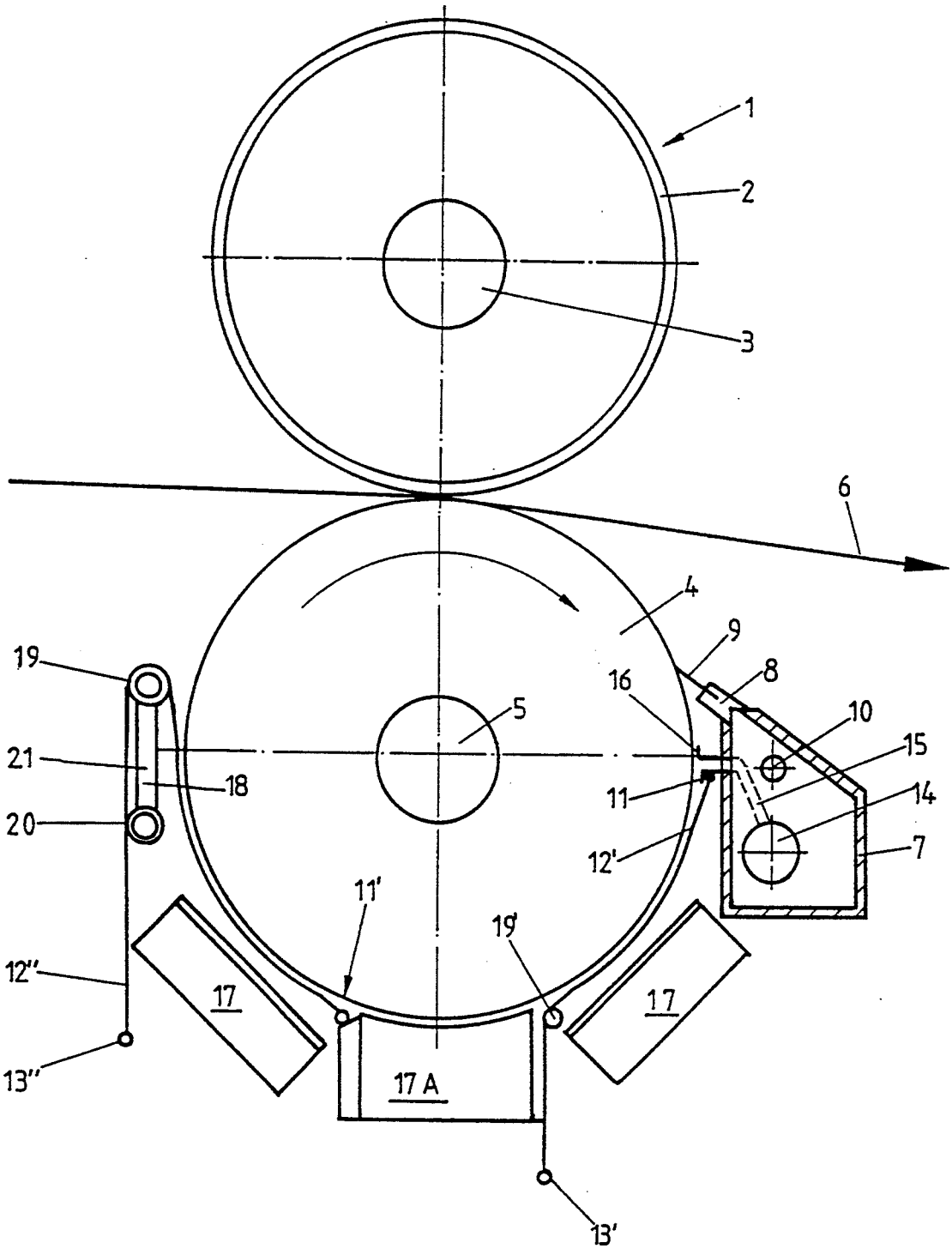
FIG. 4 is another two-roll calender.

In the embodiment according to FIG. 4, the foil is subdivided as follows: a first foil 12' and a second foil 12'' are provided, both foils being tensioned by weight slats 13' and 13''. One of the radiators 17 is replaced by an induction shoe 17A. In the area of the latter, the roll 4 is not covered by a foil. The induction shoe 17A is spaced from the shell surface of the roll 4 less than the radiator 17.

Figure 5:
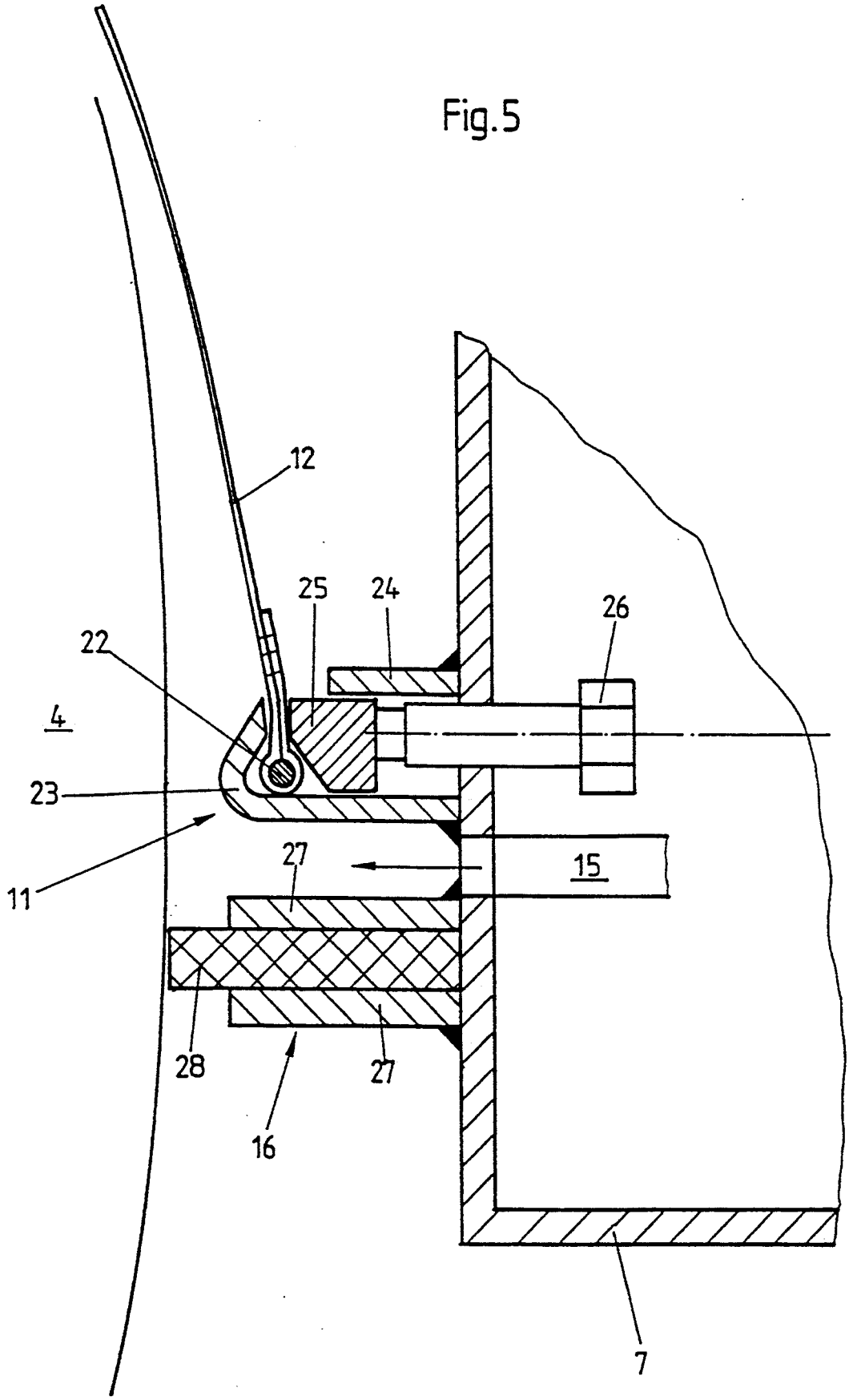
FIG. 5 illustrates, greatly scaled up, the details of fastening the foil on an inventional calender.

The illustration according to FIG. 5 shows the conditions in detail. Depicted here as well is a roll 4, a scraper body 7, a foil 12, a mounting device 11 and a strip seal 16. The foil 12 wraps in the area of the mounting about a round bar 22. The mounting device 11 is comprised of the following individual elements: holder claw 23, guide rail 24 and clamping component 25, the latter being infed rearwardly in such a way, by clamping screws 26, that the foil 12 with wire 22 cannot slip through the bottleneck between claw 23 and clamping component 25.

The strip seal is composed of two holder shanks 27 between which a felt strip 28 is fitted, which at higher temperatures also may consist of glass fibers or PTFE fibers. The air supply occurs through channels 15.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A calender for treating a material web, comprising:

at least two rolls forming with each other a roll gap for passage of the web, at least one of said rolls having a shell surface;

removable cover means, said removable cover means comprising a flexible foil which is tightened around part of the circumference of at least one of said rolls so as to form a machine-wide gap between the cover means and the shell surface of said roll, said flexible foil having two ends, and wherein said foil, viewed in an axially vertical section, is held at one end by means of a mounting device, the other end being weighted for purposes of tensioning the foil; and means for heating the material web.

2. The calender of claim 1, wherein a gas cushion is provided between the roll shell and the foil for maintaining the spacing between said shell and said foil.

3. The calender of claim 2, wherein said gas cushion comprises an air cushion.

4. The calender of claim 1, further comprising a means for producing a voltage, wherein said foil comprises an electrical conductor, said foil being heatable on at least a partial surface thereof by application of a voltage from said means for producing a voltage.

5. A calender for treating a material web, comprising:

at least two rolls forming with each other a roll gap for passage of the web, at least one of said rolls having a shell surface;

removable cover means, said removable cover means comprising a foil which is tightened around part of the circumference of at least one of said rolls so as to form a machine-wide gap between the cover means and the shell surface of said roll, said removable cover means having a low rigidity such that said foil is wrappable around a roll, said gap being maintained by way of a gas cushion between said shell and said foil, said foil having two ends, and wherein said foil, viewed in an axially vertical section, is held at one end by means of a mounting device, the other end being weighted for purposes of tensioning the foil; and means for heating the material web.

6. The calender of claim 5, further comprising means for producing a voltage, wherein said foil is electrically conducting and heated on at least a partial surface thereof by application of a voltage.

7. A calender for treating a material web, comprising:

at least two rolls forming with each other a roll gap for passage of the web, at least one of said rolls having a shell surface; removable cover means, said removable cover means comprising a foil having two ends, said foil being tightened around part of the circumference of at least one of said rolls so as to form a machine-wide gap between the cover means and the shell surface of said roll, said gap being maintained by way of a gas cushion between said shell and said foil, said foil, viewed in an axially vertical section, being held at one end by means of a mounting device, and at the other end being weighted for tensioning the foil; said mounting device comprising a portion of a traverse, said traverse being structured and arranged to support a scraper for scraping said shell surface; a blower system for blowing gas between said roll and said foil to maintain said gas cushion; a strip seal for preventing said gas from escaping from said gas cushion opposite the running direction of said roll; and means for heating the material web.

8. The calender of claim 7, wherein said gas cushion comprises an air cushion.

9. The calender of claim 7, further comprising means for producing a voltage, wherein said foil is electrically conducting and heated on at least a partial surface thereof by application of a voltage.

* * * * *